US005228734A

United States Patent [19]

Pollastro

[11] Patent Number: 5,228,734

[45] Date of Patent: Jul. 20, 1993

[54] EXPANDABLE SNOW SHOVEL DEVICE

[76] Inventor: Paul J. Pollastro, 1413 Woodward Ave., McKees Rocks, Pa. 15136

[21] Appl. No.: 914,729

[22] Filed: Jul. 20, 1992

[51] Int. Cl.[5] ..... A01B 1/22; E01H 5/02

[52] U.S. Cl. ..... 294/54.5; 37/241; 37/285; 294/51; 294/59

[58] Field of Search ..... 294/49, 51, 54.5, 55, 294/59; 37/241, 264–266, 274, 278, 281, 284, 285, DIG. 12

[56] References Cited

U.S. PATENT DOCUMENTS

| | | | |
|---|---|---|---|
| 754,042 | 3/1904 | Bohn | 294/49 |
| 807,742 | 12/1905 | Hofmann | 294/54.5 |
| 1,372,722 | 3/1921 | Paradis | 294/54.5 |
| 2,239,297 | 4/1941 | Allen et al. | 294/51 |
| 2,787,491 | 4/1957 | Roberts | 294/51 |
| 3,034,237 | 5/1962 | Wolfe et al. | 37/241 X |
| 4,073,077 | 2/1978 | Essel | 37/281 |
| 4,275,514 | 6/1981 | Maura | 37/281 |
| 4,878,704 | 11/1989 | Jacanin et al. | 294/54.5 |
| 4,991,324 | 2/1991 | Fine et al. | 294/54.5 X |

FOREIGN PATENT DOCUMENTS

| | | | |
|---|---|---|---|
| 1219507 | 6/1966 | Fed. Rep. of Germany | 37/284 |

*Primary Examiner*—Johnny D. Cherry
*Attorney, Agent, or Firm*—Daniel J. Long

[57] ABSTRACT

There is disclosed an expandable snow shovel device having a central blade element which has a single handle projecting upwardly from its upper edge. There is also at least one side blade element which abuts the central blade element end to end. Additionally, other side blade elements may be releasably fixed outwardly from the side blade adjacent to the central blade. Preferably, the blade elements also have upwardly extending flanges adjacent to their lateral edges so that they may be fixed to adjoining blade elements by releasable connecting members such as lock pins. Preferably, the blade elements are also concave in shape as viewed from their upper surface and terminate at their lower ends in an angled cutting edge.

17 Claims, 3 Drawing Sheets

EXPANDABLE SNOW SHOVEL DEVICE

BACKGROUND OF THE INVENTION

1. Field of the Invention

The present invention relates to hand tools and implements and more particularly to snow shovels.

2. Brief Description of the Prior Art

In removing snow manually from sidewalks, driveways and like, considerably different amounts of effort may be required in different situations depending on factors such as the depth and consistency of the snow to be removed. Typically, with a snow shovel of a standard width, a user may be overburdened when removing deep snow or his rate of work may be impeded in clearing a light snow covering. Furthermore, many shovels which would be suitable for removing snow from an expansive area such as a driveway may be cumbersome or even unsuitable for use on a narrow walkway. Such wide shovels may also be unsuitable in situations in which the user is attempting to maximize the force being applied to a limited area for the purpose of breaking ice or tightly packed snow away from a paved surface. At the same time, however, a shovel having a narrow blade, which might be well adapted for removing deep or packed snow or ice or for clearing a narrow walk, might be unduly time consuming for removing a light snow covering from an expansive surface such as a driveway.

U.S. Pat. No. 4,991,324 suggests that a snow removal device might be equipped with an adjustable blade by means of two overlapping planar snow removal surfaces which are engaged by means of a locking plate engaging both surfaces and multiple handles are also provided. While the device provides an adjustable blade, it would appear to be adapted to the removal of particularly large amounts of snow, possibly by more than one operator.

SUMMARY OF THE INVENTION

An object of the present invention is to provide a snow shovel device having an adjustable blade which may be readily used by a single individual and which may incorporate the advantage of a curved or concave blade surface.

In this device there is a central blade element which has a single handle projecting upwardly from its upper edge. There is also at least one side blade element which abuts the central blade element end-to-end. Additionally, other side blade elements may be releasably fixed outwardly from the side blade adjacent to the central blade. Preferably, the blade elements also have upwardly extending flanges adjacent to their lateral edges so that they may be fixed to adjoining blade elements by releasable connecting means such as lock pins. Preferably, the blade elements are also concave in shape as viewed from their upper surface and terminate at their lower ends in an angled cutting edge.

BRIEF DESCRIPTION OF THE DRAWINGS

The device of the present invention is further described with reference to the attached drawings in which.

DETAILED DESCRIPTION OF THE DRAWINGS

Figure 1:
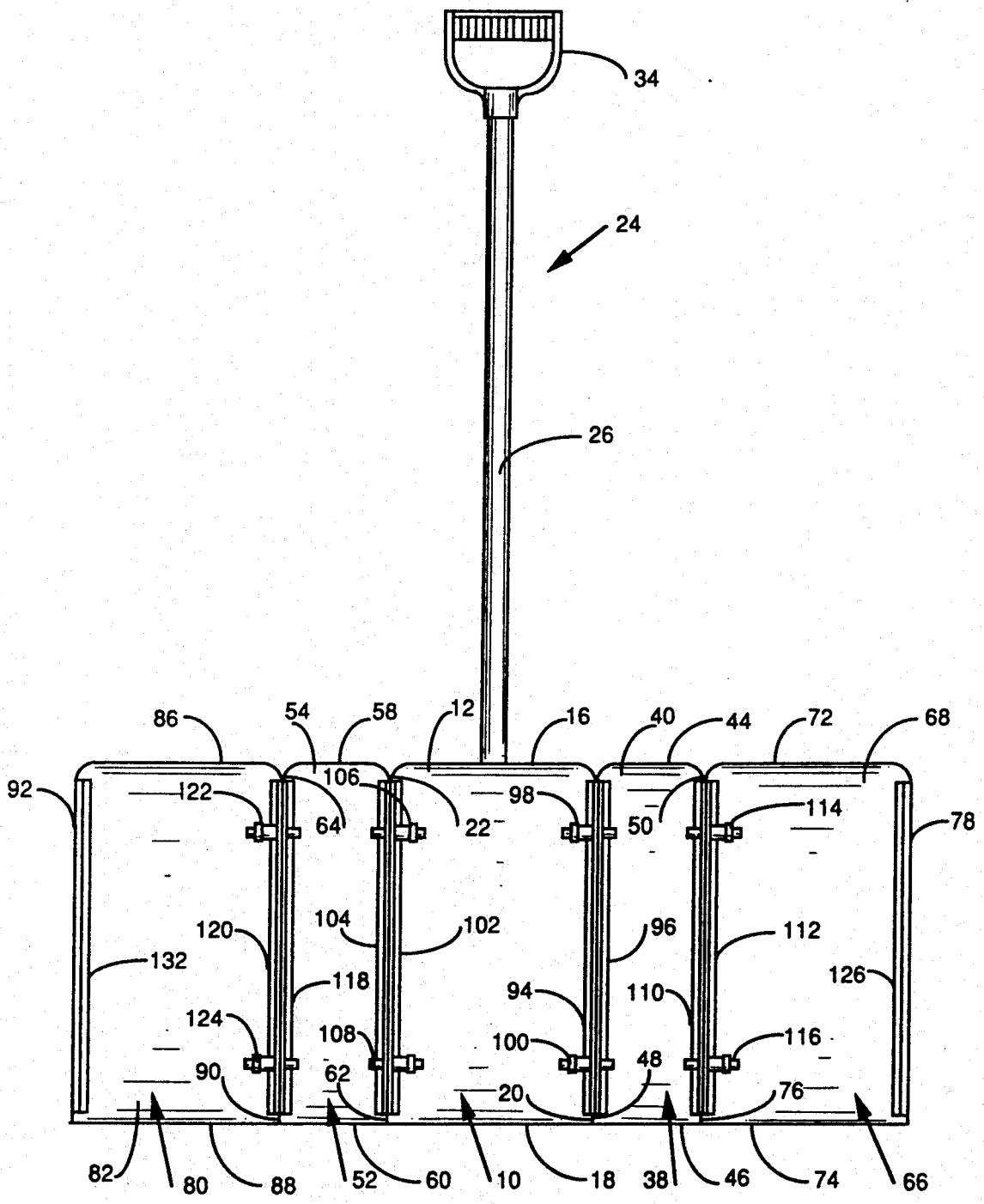
FIG. 1 is a front view.
Figure 2:
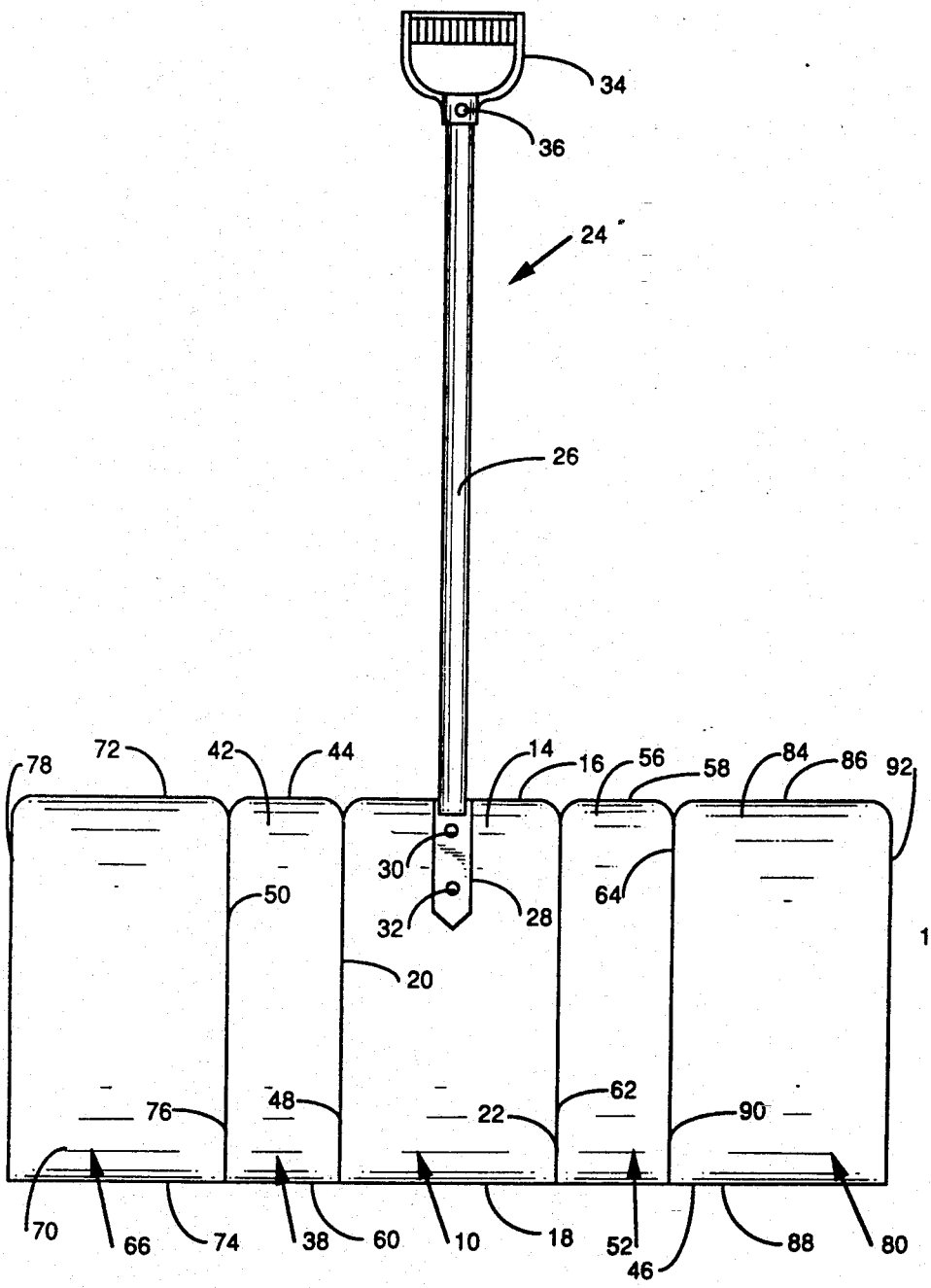
FIG. 2 is a rear view of the shovel device shown in FIG. 1.

Referring to the drawings, the central blade element 10 consists of a top planar surface 12, a bottom planar surface 14, a top edge 16, a bottom edge 18, a first lateral edge 20 and a second lateral edge 22. Extending upwardly from the central blade element, there is a handle shown generally at numeral 24. This handle consists of a shaft 26 and a retaining cylinder 28 by which the shaft is fixed to the central blade by means of screws 30 and 32 (FIG. 2). The handle also includes a hand grip 34 which is fixed to the shaft by means of screw 36 (FIG. 2). Adjacent a central blade element there is a first side blade element shown generally in 38. This side blade element comprises a top planar surface 40, a bottom planar surface 42 (FIG. 2), an upper edge 44, a lower edge 46, a first lateral edge 48 and a second lateral edge 50. To the opposite side of the central blade element there is a second side blade element shown generally shown at 52. This second side blade element is comprised of a top planar surface 54, a bottom planar surface 56 (FIG. 2), an upper edge 58, a lower edge 60, a first lateral edge 62 and a second lateral edge 64. It will be seen that this second side blade element abuts the central blade element end-to-end and that the first lateral edge 62 is adjacent to the second lateral edge 22 of the central blade element. Outwardly from the first side blade element 38 there is a third side blade element shown generally at numeral 66. This third side blade element is comprised of a top planar surface 68, a bottom planar surface 70 (FIG. 2), an upper edge 72, a lower edge 74, a first lateral edge 76 and a second lateral edge 78. It will be seen that this third side blade element abuts the first side blade element end-to-end such that the first lateral edge 76 of the third side blade element is adjacent to the second lateral edge 50 of the first side blade element. Finally, on the opposite side of the shovel device from the third side blade element 66 there is a fourth side blade element shown generally at numeral 80. This fourth side blade element consists of a top planar surface 82, a bottom planar surface 84 (FIG. 2), an upper edge 86, a lower edge 88, a first lateral side 90 and a second lateral side 92. This fourth lateral side blade element abuts the second lateral blade element end-to-end such that its first lateral side 90 is adjacent to second lateral side 64 of the second side blade element.

Figure 3:
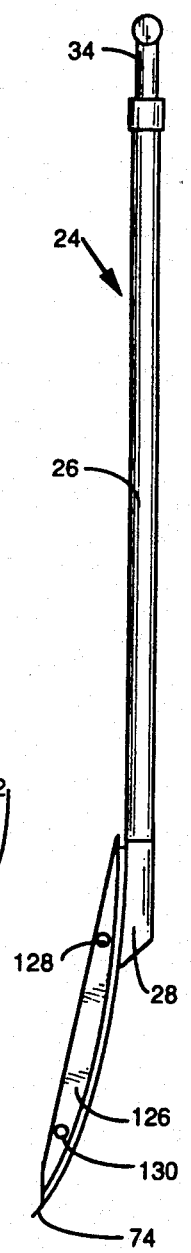
FIG. 3 is a side view of the shovel device.
Figure 5:
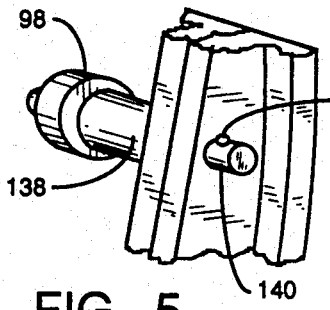
FIG. 5 is a detailed view of the area within Circle V in FIG. 4.
Figure 4:
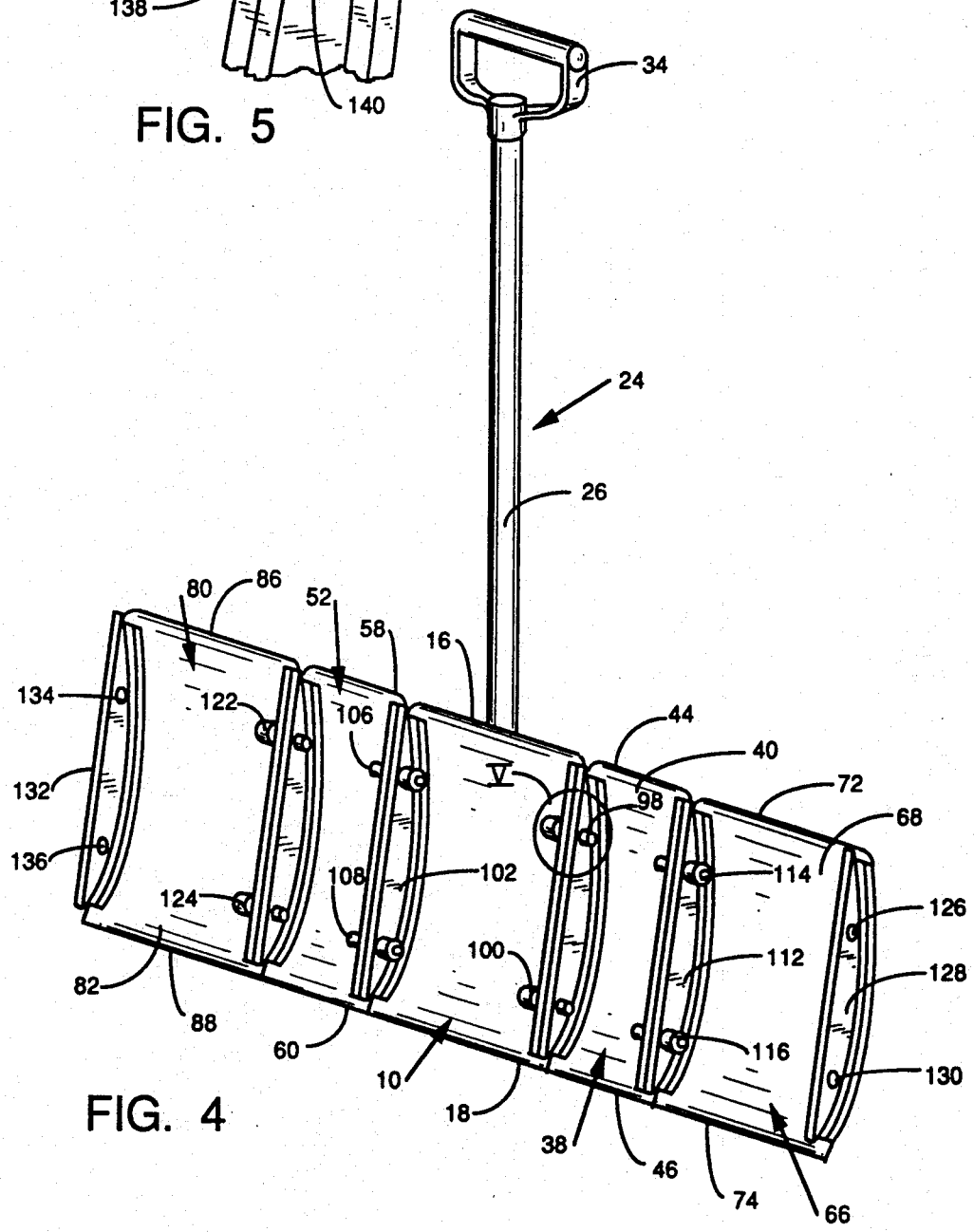
FIG. 4 is a perspective view of the shovel device shown in FIG. 1.

In the preferred embodiment of the present invention, the above described side-by-side elements are releasably connected to one another by means of a system of flanges and lock pins. On the center side blade element adjacent to and running longitudinally with the first lateral edge there is a flange 94. It will be seen that this flange extends perpendicularly upwardly from the top planar surface of that center blade element. Similarly, on the first side blade element, there is a flange 96 which extends perpendicularly upwardly from its top planar surface. This flange is adjacent to and runs longitudinally with the first lateral edge 48. There are a pair of apertures in these flanges which are longitudinally aligned with each other such that lock pins 98 and 100 extend therethrough and connect the center blade element and the first side blade element to one another. Adjacent the second lateral side and running longitudinally with said side of the center blade element, there is also a second flange 102 which also extends perpendicularly upwardly from the top planar surface of that blade element. On the second side blade element there is a first flange 104 adjacent the flange 102. This flange 104 extends upwardly from the upper surface of the second side blade element and runs longitudinally adjacent the first lateral edge of said blade element. There are a pair of longitudinally aligned apertures in the flanges 102 and 104 and through these apertures there are lock pins 106 and 108 which releasably hold the second side blade element to the center blade element. Running longitudinally adjacent to the second lateral edge of the first side blade element, there is a second flange 110. Running longitudinally adjacent the first lateral edge of the third side blade element there is a first flange 112. Again there are a pair of aligned apertures through the flanges 110 and 112 through which pins 114 and 116 pass to releasably fix these blade elements together. Running longitudinally adjacent to the second lateral edge of the second side blade element there is a second flange 118 on said second lateral blade element extending perpendicularly upwardly from its top planar surface. Running longitudinally adjacent to the first lateral edge of the fourth side blade element there is also a first flange 120 extending perpendicularly upwardly from the top planar surface of said fourth side blade element. There are a pair of longitudinally aligned apertures through said flanges 118 and 120 such that lock pins 122 and 124 releasably fix the second side blade element to the fourth side blade element. It will also be observed that there is a second flange 126 on the third side blade element with a pair of apertures 128 and 130 (FIGS. 3 and 4). It will be appreciated by those skilled in the art that another side blade element having a similar aperture and flange configuration could be positioned adjacent to this third side blade element to further expand the shovel device by means of lock pins as were described in connection with the other side blade elements. Similarly, it will be observed that on the fourth side blade element there is a second flange 132 which has apertures 134 and 136 (FIG. 4) which may also be connected to another side blade element to still further expand this shovel device. Referring to FIG. 5, it will be seen that the lock pins comprise a base section 138 which abuts one flange as at 94. Extending from this base section through apertures in the flanges as at 94 and 96, there is a shaft section 140 which has a terminal latch 142. This terminal latch engages a flange as at 96 to releasably connect blade sections to each other. This latch 142 is itself spring mounted to allow the lock pin to be disengaged from the flange. The shaft section 140 is spring mounted in the base section 138 so as to be depressible therein and allow this connection of the lock and assembly from the flange as at 96. A preferred pin for use in the above-described assembly, is available from Fokker Aircraft of College Park, Ga. under part no. TAN 16427-6X 155 code A 1755.

Preferably, the central blade element in the shovel device described above will be about 6 to 12, and most preferably, 8 inches in width. The first and second side blade elements will preferably each be about 6 to 12, and most preferably 5 inches in width. The third and fourth side blade elements will preferably each be about 6 to 12 and most preferably 9 inches in width. These blades would also be about 12 inches in height and would preferably be constructed of a suitable plastic or sheet metal and be about 1/16 to 3/16 inch in thickness.

What is claimed is:

1. A shovel device comprising:

(a) a central blade element having a top and a bottom surface, upper and lower edges and first and second generally parallel lateral edges and adjacent the first lateral edge there is a flange running generally parallel to said first lateral edge and projecting from the top surface;

(b) a handle element projecting upwardly from the upper edge of the blade element; and (c) a side blade element itself having a top and a bottom surface, upper and lower edges and first and second generally parallel lateral edges and adjacent the first lateral edge of the first side blade element there is a flange running generally parallel to the first lateral edge of the first side blade element and projecting from the top surface of said first side blade element such that said flange and the flange adjacent the first lateral edge of the central blade element are positioned in abutting side by side relation and means are attached to said flanges for releasably connecting said flanges, wherein the first lateral edge of the side blade element abuts the first lateral edge of the central blade element such that the said blade element is releasably connected end-to-end to the central blade element.

2. The shovel device recited in claim 1 wherein there is a second side blade element having a top and a bottom surface, upper and lower edges and first and second parallel lateral edges, wherein the first lateral edge of said second side blade element abuts the second lateral edge of the central blade element such that said second side blade element is releasably connected end-to-end to the central blade element in opposed relation to the first side blade element.

3. The shovel device recited in claim 2 wherein there is a third side blade element having a top and a bottom surface, upper and lower edges and first and second parallel lateral edges, wherein the first lateral edge of said third side blade element abuts the second lateral edge of the first side blade element such that said third side blade element is releasably connected end-to-end to the first side blade element.

4. The shovel device recited in claim 3 wherein there is a fourth side blade element having a top and a bottom surface, upper and lower edges and first and second parallel lateral edges, wherein the first lateral edge of said fourth side blade element abuts the second lateral edge of the second side blade element such that said fourth side blade element is releasably connected end-to-end to the second side blade element.

5. The shovel device recited in claim 4 wherein adjacent the second lateral edge of the second side blade element there is a flange running generally parallel to said second lateral edge and projecting upwardly from the top surface and wherein there is adjacent the first lateral edge of the fourth side blade element a flange running generally parallel to the first lateral edge of the fourth side blade element and such that said flanges are positioned in abutting side by side relation and wherein means for removably connecting the second side blade element to the fourth side blade element are fixed to said flanges.

6. The shovel device recited in claim 5 wherein there is a pair of spaced apertures through the flange projecting from the central blade element and a pair of spaced apertures in the flange projecting from the second side blade element wherein each of said apertures in the flange projecting from the second side blade element is longitudinally aligned with one of the apertures in the flange projecting from the fourth blade element and wherein pins having opposed terminal ends and having locking means on at least one of their terminal ends extend through the aligned apertures to allow said flanges to be releasably connected.

7. The shovel device recited in claim 4 wherein the central blade element and the third side blade element and fourth side blade element are similarly concave viewed from the top surfaces and have aligned top and bottom surfaces and upper and lower ends wherein said lower ends are formed into a scraping edge.

8. The shovel device recited in claim 3 wherein adjacent the second lateral edge of the first side blade element there is a flange running generally parallel to said second lateral edge and projecting upwardly from the top surface and wherein there is adjacent the first lateral edge of the third side blade element a flange running generally parallel to the first lateral edge of the third side blade element and such that said flanges are positioned in abutting side by side relation and wherein means for removably connecting the first side blade element to the third side blade element abut said flanges.

9. The shovel device recited in claim 8 wherein there is a pair of spaced apertures through the flange projecting from the central blade element and a pair of spaced apertures in the flange projecting from the first side blade element wherein each of said apertures in the flange projecting from the first side blade element is longitudinally aligned with one of the apertures in the flange projecting from the central blade element and wherein pins having opposed terminal ends and having locking means on at least one of their terminal ends extend through the aligned apertures to allow said flanges to be releasably connected.

10. The shovel device recited in claim 2 wherein adjacent the second lateral edge of the central blade element there is a flange running generally parallel to said second lateral edge and projecting upwardly from the top surface and wherein there is adjacent the first lateral edge of the second side blade element a flange running generally parallel to the first lateral edge of the second side blade element and such that said flanges re positioned in abutting side by side relation and wherein means for removably connecting the central blade element to the second side blade element abut said flanges.

11. The shovel device recited in claim 10 wherein there is a pair of spaced apertures through the flange projecting from the central blade element and a pair of spaced apertures in the flange protecting from the second side blade element wherein each of said apertures in the flange projecting from the second side blade element is longitudinally aligned with one of the apertures in the flange projecting from the central blade element and wherein pins having opposed terminal ends and having locking means on at least one of their terminal ends extend through the aligned apertures to allow said flanges to be releasably connected.

12. The shovel device recited in claim 2 wherein the central blade element and the first side blade element and the second side blade element are similarly concave viewed from the top surfaces and have aligned top and bottom surfaces and upper and lower ends wherein said lower ends are formed into a scraping edge.

13. The shovel device recited in claim 2 wherein the central blade element is about 6–12 inches in width and the first and second side blade elements are about 6–12 inches in width.

14. The shovel device recited in claim 13 wherein the central blade element is about 6–12 inches in width and the first and second side blade elements are about 6–12 inches in width and the third and fourth side blades which are about 6–12 inches in width.

15. The shovel device recited in claim 13 wherein the central and side blade elements are constructed of plastic of about 1/16 to 3/16 inch in thickness.

16. The shovel device recited in claim 13 wherein the central and side blade elements are constructed of sheet metal of about 1/16 to 3/16 inch in thickness.

17. The shovel device recited in claim 1 wherein there is a pair of spaced apertures through the flange projecting from the central blade element and a pair of spaced apertures in the flange projecting from the first side blade element wherein each of said apertures in the flange projecting from the first side blade is longitudinally aligned with one of the apertures in the flange projecting from the central blade element and wherein pins having opposed terminal ends and having locking means on at least one of their terminal ends extend through the aligned apertures to allow said flanges to be releasably connected.

* * * * *